US010106956B2

(12) United States Patent
Colwell et al.

(10) Patent No.: US 10,106,956 B2
(45) **Date of Patent: *Oct. 23, 2018**

(54) COUNTERWEIGHT SYSTEM FOR AN INDUSTRIAL MACHINE

(71) Applicant: Harnischfeger Technologies, Inc., Wilmington, DE (US)

(72) Inventors: Joseph Colwell, Hubertus, WI (US); James Hutsick, Racine, WI (US); Daniel Schlegel, Germantown, WI (US); Christopher T. Larson, Waukesha, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/624,101

(22) Filed: Jun. 15, 2017

(65) Prior Publication Data

US 2017/0284061 A1 Oct. 5, 2017

Related U.S. Application Data

(63) Continuation of application No. 13/803,523, filed on Mar. 14, 2013, now Pat. No. 9,702,114.

(60) Provisional application No. 61/677,919, filed on Jul. 31, 2012, provisional application No. 61/619,830, filed on Apr. 3, 2012.

(51) Int. Cl.
*E02F 9/18* (2006.01)

(52) U.S. Cl.
CPC ..... *E02F 9/18* (2013.01)

(58) Field of Classification Search
CPC ..... B66C 23/72; B66C 23/74; B62D 49/0628; B62D 49/085; B66F 9/07554; E02F 9/18
USPC ..... 414/719
See application file for complete search history.

(56) References Cited

U.S. PATENT DOCUMENTS 2,701,728 A * 2/1955 Miller ..... B62D 49/085 180/313
2,925,149 A 2/1960 Hughson
2,985,317 A * 5/1961 Bannister ..... B66C 23/74 212/195
3,490,787 A 1/1970 Latterman et al.
3,614,136 A 10/1971 Dent
(Continued)

FOREIGN PATENT DOCUMENTS

CN 1718945 1/2006
CN 202117100 1/2012
(Continued)

OTHER PUBLICATIONS

First Office Action from the State Intellectual Property Office of the People's Republic of China for Application No. J01310206713.9 dated Apr. 15, 2016 (19 pages).
(Continued)

*Primary Examiner* — Matthew D. Troutman
(74) *Attorney, Agent, or Firm* — Michael Best & Friedrich LLP

(57) ABSTRACT

A counterweight system for an industrial machine includes a body having a front end and a back end, the body defining a cavity, and a plurality of walls defining a plurality of discrete sections within the body, each discrete section having an aperture for inserting a counterweight into the cavity.

17 Claims, 14 Drawing Sheets

(56) References Cited

U.S. PATENT DOCUMENTS 3,853,231 A * 12/1974 Luttrell ..... E02F 9/18 280/759
3,900,272 A * 8/1975 Domenighetti ..... E01C 19/233 404/130
4,032,016 A * 6/1977 Graf ..... B66C 23/74 212/196
4,068,876 A * 1/1978 Muellner ..... B62D 49/085 280/759
4,081,081 A * 3/1978 Morrow, Sr. ..... B66C 23/36 212/178
4,232,883 A 11/1980 Bourgeous et al.
4,570,986 A 2/1986 Sams
5,016,932 A 5/1991 Carter
5,039,119 A 8/1991 Baughman
5,141,195 A 8/1992 Toda et al.
5,330,227 A 7/1994 Anderson
D393,268 S 4/1998 Tachinou et al.
6,047,791 A * 4/2000 Hoebelheinrich .. B66F 9/07554 187/222
6,296,436 B1 * 10/2001 Ramun ..... E02F 9/18 212/195
D455,763 S 4/2002 Brandenburg et al.
6,481,748 B1 11/2002 Okuda et al.
6,880,854 B2 4/2005 Powell
7,036,251 B2 5/2006 Kojima et al.
D559,279 S 1/2008 Sakitani et al.
7,354,066 B2 4/2008 Yamamoto
D579,465 S 10/2008 Ochi et al.
D582,947 S 12/2008 Ueta et al.
7,467,722 B2 12/2008 Ramun
D587,285 S 2/2009 Murakami et al.
7,717,486 B2 * 5/2010 Kokladas ..... B60R 99/00 280/757
8,033,572 B2 10/2011 Arzberger et al.
8,118,326 B2 2/2012 Moore
8,162,160 B2 4/2012 Zollondz et al.
D681,068 S 4/2013 Larson et al.
8,419,064 B2 * 4/2013 Erhardt ..... B62D 49/0628 224/519
8,430,427 B1 * 4/2013 Gaeddert ..... B62D 49/085 212/195
8,540,042 B2 * 9/2013 Atarashi ..... B60K 1/04 180/68.1
2002/0014506 A1 2/2002 Teich
2005/0012314 A1 * 1/2005 Kubo ..... B62D 49/085 280/757
2007/0107269 A1 * 5/2007 Hren ..... E02F 3/4075 37/398
2008/0053944 A1 3/2008 Ramun
2008/0253875 A1 * 10/2008 Yamamoto ..... B66C 23/74 414/719
2010/0224583 A1 9/2010 Mentink et al.
2011/0031202 A1 2/2011 Pech et al.
2011/0031728 A1 2/2011 Arzberger et al.
2012/0285757 A1 * 11/2012 Atarashi ..... B60K 1/04 180/68.1
2014/0219763 A1 * 8/2014 Bienfang ..... E02F 9/18 414/719
2016/0319495 A1 * 11/2016 de Sylos ..... E01C 19/22

FOREIGN PATENT DOCUMENTS

CN 203393772 1/2014
EP 0264172 4/1988
GB 2423510 4/1988
JP 2008-267038 * 11/2008

OTHER PUBLICATIONS

Patent Examination Report No. 1 from the Australian Patent Office for Application No. 2013202936 dated Jan. 27, 2015 (7 pages).
Lift Systems, Inc., 33 Ton Mobilifl, equipment brochure (2009) 8 pages, East Moline, USA.
Project Tina, 2009. http://www.aaroncake.net/rx-7/projecttina/year2009-3.htm.

* cited by examiner

COUNTERWEIGHT SYSTEM FOR AN INDUSTRIAL MACHINE

CROSS REFERENCE TO RELATED APPLICATIONS

This application is a continuation of U.S. patent application Ser. No. 13/803,523, filed Mar. 14, 2013, which claims priority to U.S. Provisional Application No. 61/677,919, filed Jul. 31, 2012, and to U.S. Provisional Application No. 61/619,830, filed Apr. 3, 2012, the entire contents of each of which are incorporated herein by reference.

FIELD OF THE INVENTION

The present invention relates to counterweights, and more particularly, to an improved counterweight system for an industrial machine.

BACKGROUND OF THE INVENTION

In the mining field, and in other fields in which large volumes of material are collected and removed from a work site, it is typical to employ industrial machines that include large dippers for shoveling the material from the work site. Industrial machines, such as electric rope or power shovels, draglines, etc., are used to execute digging operations to remove the material from, for example, a bank of a mine. These industrial machines generally include counterweight structures added to the rear end of the machine, the counterweight structures being used to balance the machine during operations of the machine.

The current counterweight structures of many industrial machines include a large counterweight box having a plurality of openings on the top of the counterweight box. Operators manually dispense ballast from large barrels into the plurality of openings positioned on the top of the counterweight box. After the counterweight box is filled with the ballast, the openings on the top of the counterweight box are welded shut. Filling the counterweight box is performed before a rear room of the machine is installed on top of the counterweight box. Therefore, assembly of the rear room and the rest of the machine is halted until the entire counterweight box is filled with ballast.

The current counterweight structures of many industrial machines also include counterweight casting slabs bolted and/or welded to the rear end of the counterweight box. These casting slabs tend to break and fall off during the operation of the machine, such as when the machine swings to unload material into a loading vehicle and the counterweight box hits the loading vehicle.

SUMMARY

In accordance with one construction, a counterweight system for an industrial machine includes a body having a front end and a back end, the body defining a cavity, and a plurality of walls defining a plurality of discrete sections within the body, each discrete section having an aperture for inserting a counterweight into the cavity.

In accordance with another construction, a counterweight system for an industrial machine includes a body defining a cavity, the body including a top wall, a bottom wall, a first side wall, a second side wall, a closed end, an open end for providing access to the cavity, and a plurality of internal walls defining discrete sections within the body. Each section extends along a portion of the open end. The counterweight system also includes a plurality of counterweight units, each counterweight unit sized to fit within one of the sections Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
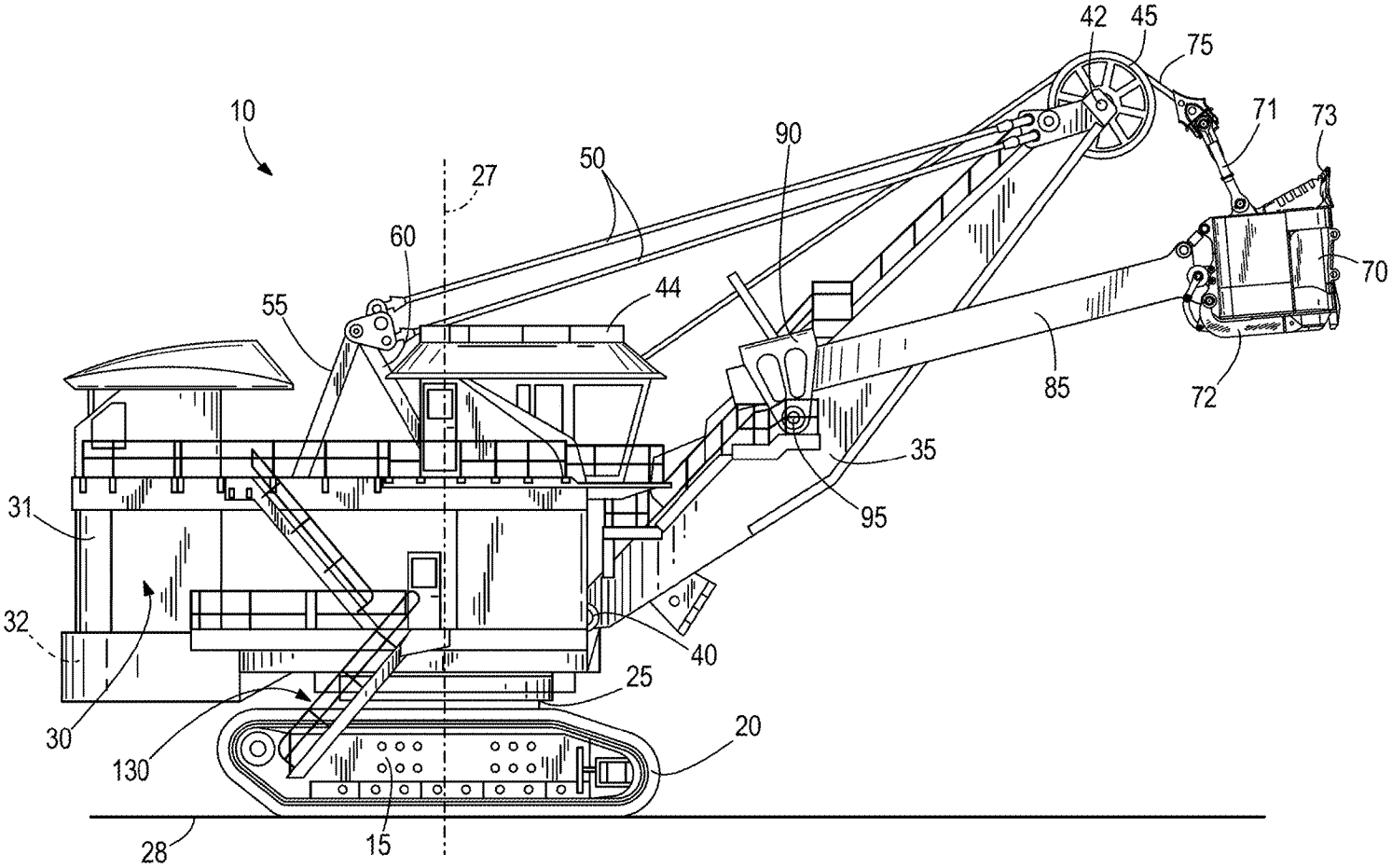
FIG. 1 is a side view of an industrial machine including a current counterweight system.

FIG. 1 illustrates a power shovel 10. Although the counterweight systems described herein are described in the context of the power shovel 10, the counterweight systems can be applied to, performed by, or used in conjunction with a variety of industrial machines (e.g., draglines, shovels, tractors, etc.).

The shovel 10 includes a mobile base 15, drive tracks 20, a turntable 25, a revolving frame 30 with a rear room 31, a common counterweight system 32 attached to a rear end of the revolving frame 30 below the rear room 31, a boom 35, a lower end 40 of the boom 35 (also called a boom foot), an upper end 42 of the boom 35 (also called a boom point), tension cables 50, a gantry tension member 55, a gantry compression member 60, a dipper 70 having a door 72 and teeth 73, a hoist rope 75, a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 27 of the shovel 10. The rotational axis 27 is perpendicular to a plane 28 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30, and a sheave 45 is rotatably mounted on the upper end 42 of the boom 35.

The dipper 70 is suspended from the boom 35 by the hoist rope 75. The hoist rope 75 is wrapped over the sheave 45 and attached to the dipper 70 at a bail 71. The hoist rope 75 is anchored to the winch drum (not shown) of the revolving frame 30. The winch drum is driven by at least one electric motor (not shown) that incorporates a transmission unit (not shown). As the winch drum rotates, the hoist rope 75 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
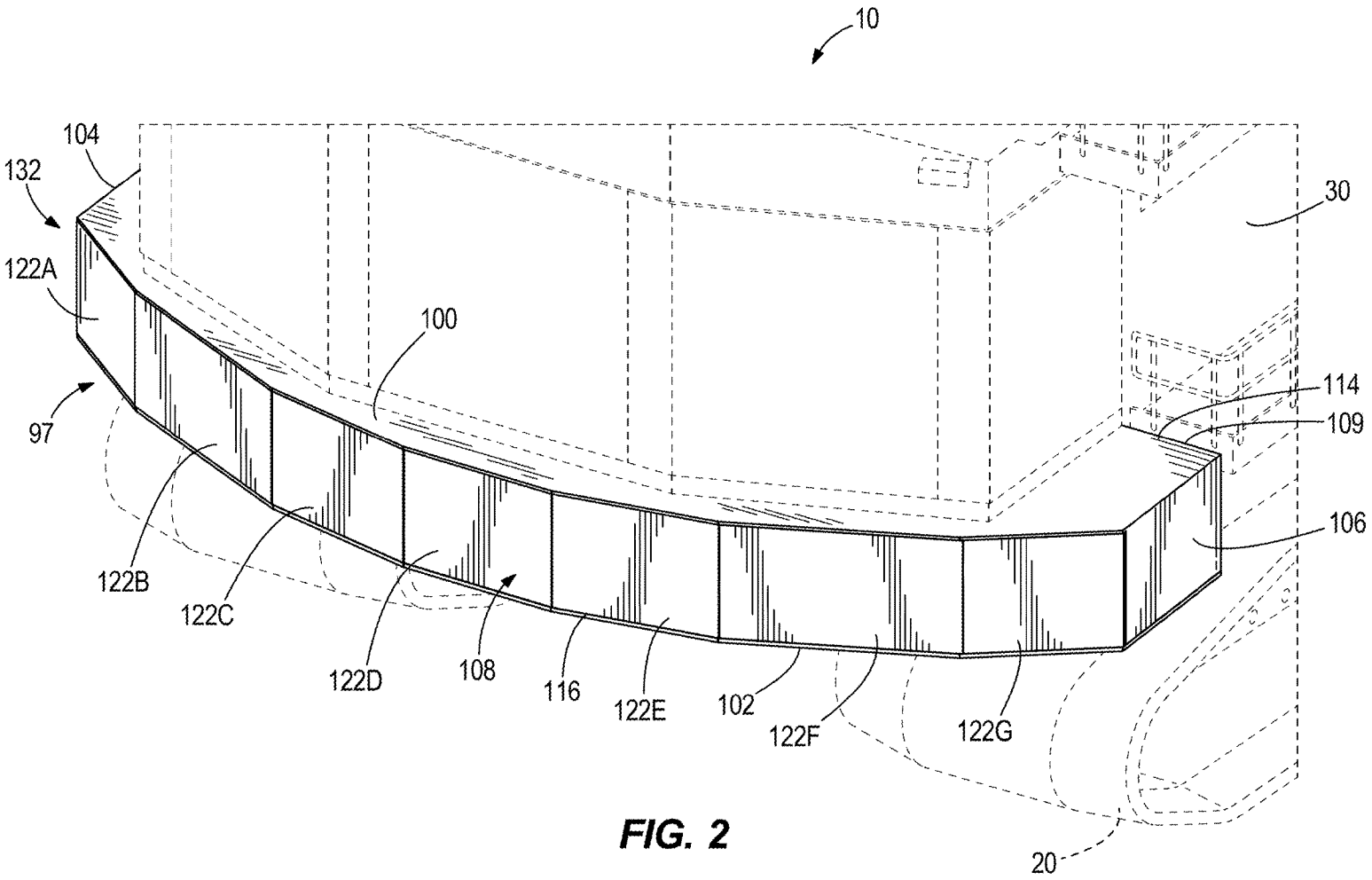
FIG. 2 is a front side perspective view of an improved counterweight system according to one construction of the invention, the improved counterweight system attached to the industrial machine of FIG. 1 in place of the current counterweight system.
Figure 3:
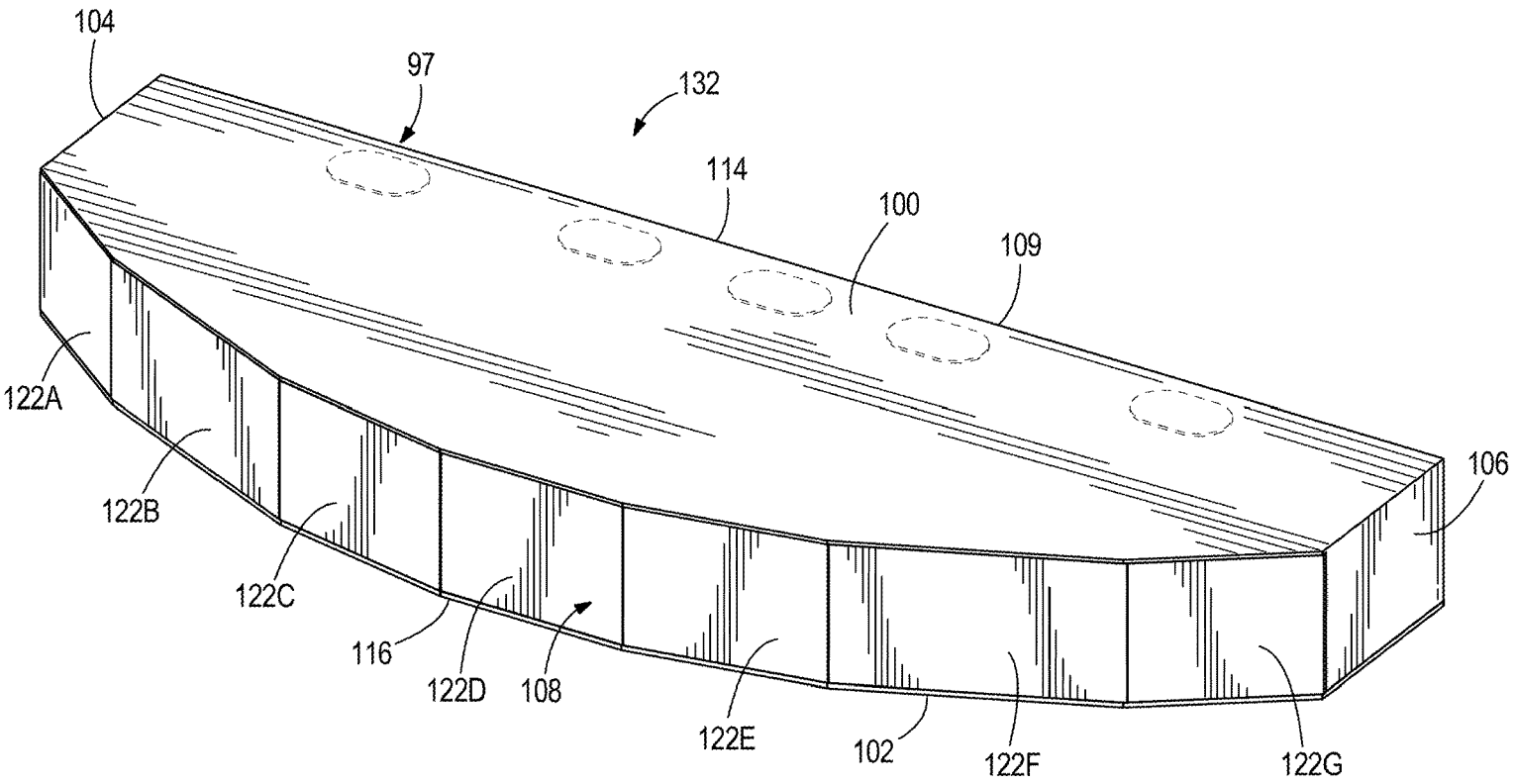
FIG. 3 is a front side perspective view of the counterweight system of FIG. 2, detached from the industrial machine.
Figure 4:
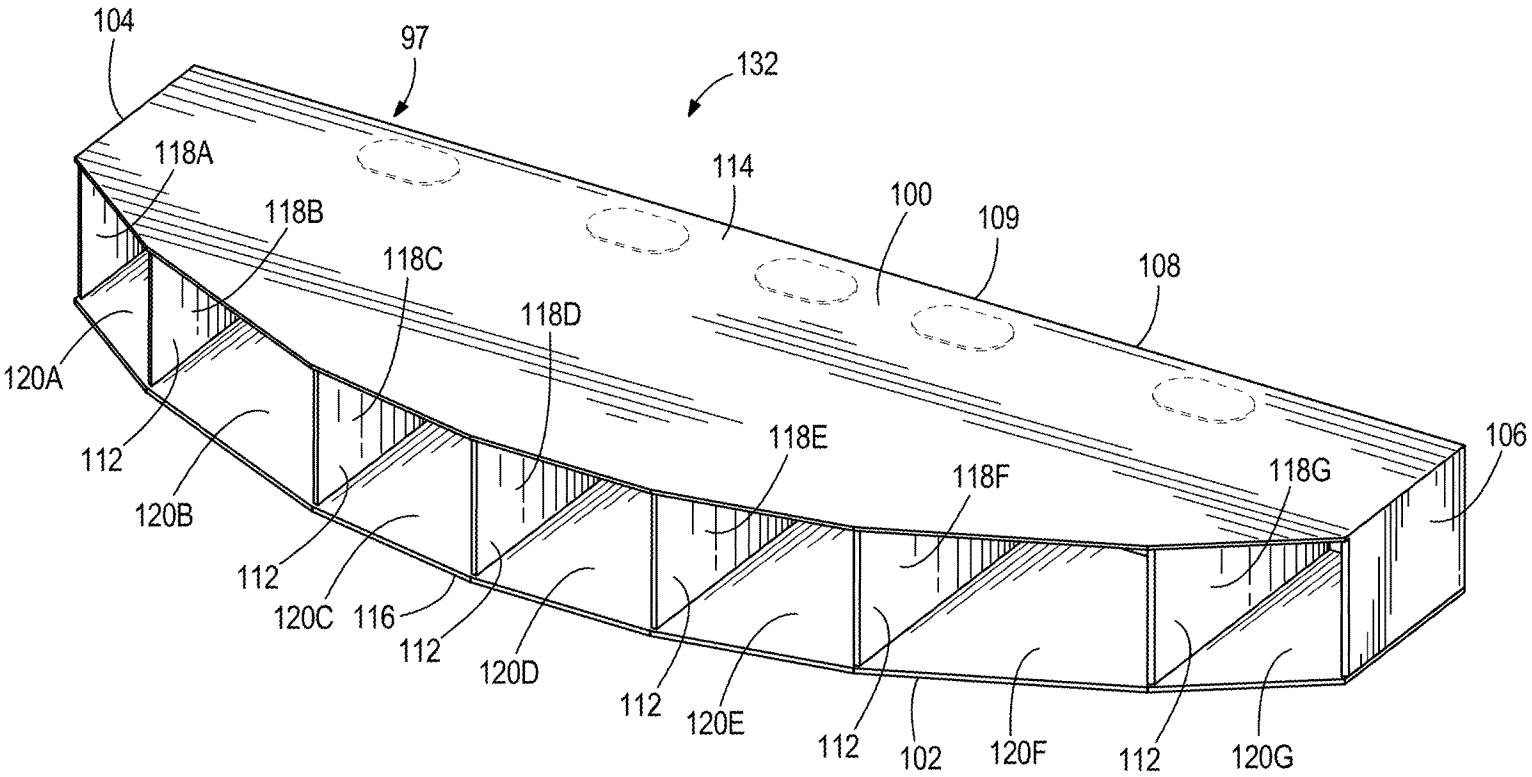
FIG. 4 is a front side perspective view of the counterweight system of FIG. 2, with doors removed.

FIGS. 2-4 illustrate an improved counterweight system 132 according to one construction of the invention and for use with the shovel 10. The counterweight system 132 includes a body or counterweight box 97 defining a cavity for holding counterweight units (slabs in the illustrated construction). The counterweight box 97 includes a top wall 100, a bottom wall 102, a first side wall 104, a second side wall 106, a back wall 108, a front wall 109, and internal walls 112 (FIG. 4). In the illustrated construction, the top wall 100 and the bottom wall 102 are coupled (e.g. welded and/or bolted) to the side walls 104 and 106, the back wall 108, and the front wall 109. The counterweight box 97 defines a first, front end 114 and a second, back end 116, the first, front end 114 being positioned closer to the rotational axis 27 of the shovel 10 than the second, back end 116. The first end 114 is a closed end, and the second end 116 (without doors) is an open end. The internal walls 112 extend along a direction from the front wall 109 to the back wall 108. As illustrated in FIG. 4, the walls 100, 102, 104, 106, 108, 109, and 112 define a plurality of sections 118A-118G for inserting modular counterweight units. The counterweight box 97 includes seven sections 118A-118G. In some constructions, the counterweight box 97 includes different numbers of internal walls 112 and, consequently, different numbers of sections 118. The sections 118A-G extend along the open second end 116.

With continued reference to FIG. 4, the first section 118A is defined by the first side wall 104, a first internal wall 112, and a portion of the top wall 100, bottom wall 102, back wall 108, and front wall 109. The first section 118A defines a first aperture 120A extending into the first section 118A. The seventh section 118G is defined by the second side wall 106, a seventh internal wall 112, and a portion of the top wall 100, bottom wall 102, back wall 108, and front wall 109. The seventh section 118G defines a seventh aperture 120G extending into the seventh section 118G. Consequently, the rest of the sections 118B-118F are defined by the rest of the internal walls 112, and a portion of the top wall 100, bottom wall 102, back wall 108, and front wall 109. Sections 118B-118F define apertures 120B-120F, respectively. In the illustrated construction, at least one of the sections 118A-G is of a different size than one of the other sections 118A-G. Specifically, the second section 118B and the sixth section 118F are larger than the rest of the sections 118A, 118C-E, and 118G. However, in other constructions the sections 118A-G are all of generally equal size, or other section may be of differing size.

With reference to FIGS. 2 and 3, the back wall 108 of the counterweight box 97 includes a plurality of doors 122A-122G that correspond to a shape of the sections 118A-118G. The first door 122A is positioned at the back end 116 of section 118A. In other constructions the back wall 108 includes fewer or more doors 122 than that shown in FIGS. 2 and 3. In particular, in at least one construction a single door 122 covers two or more sections 118. The doors 122A-122G are welded and/or bolted to the walls 100, 102, 104, 106, and 112 of the counterweight box 97, and define the back wall 108 of the system 132.

Figure 5:
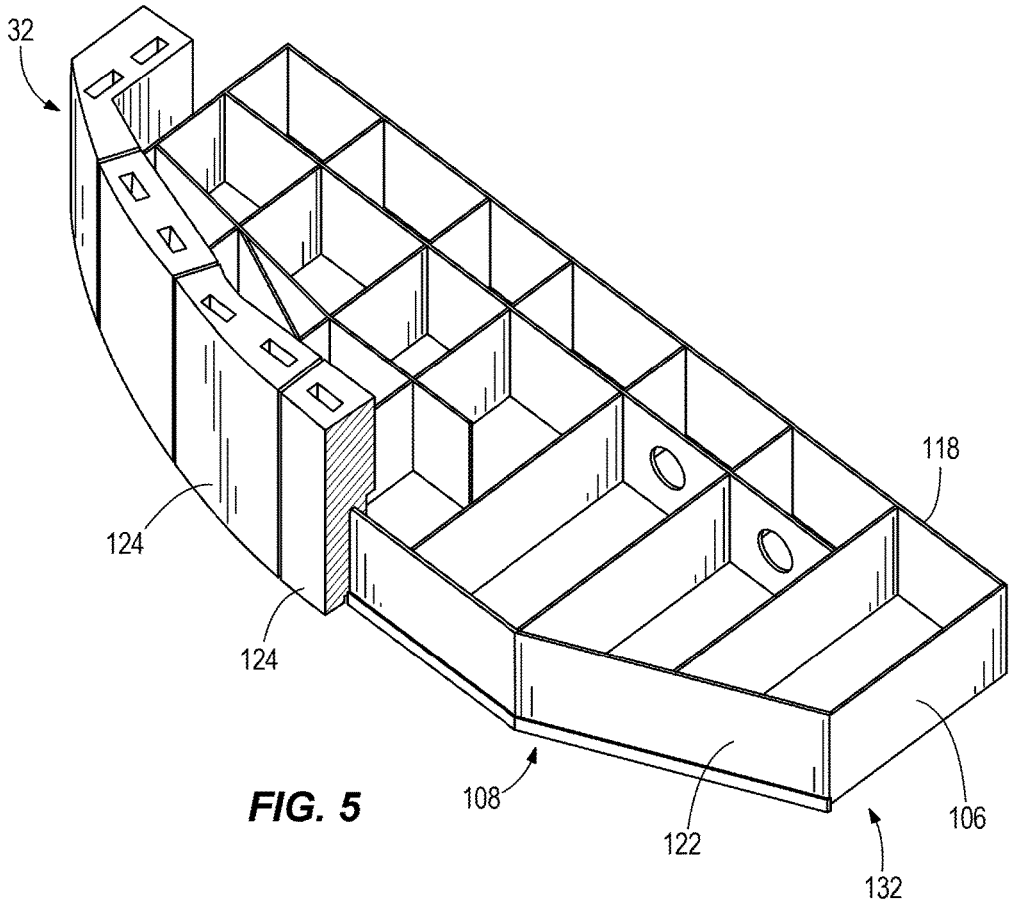
FIG. 5 illustrates a front side perspective comparison view of the current counterweight system from FIG. 1 and the counterweight system of FIG. 2, wherein the top walls of the counterweight systems are removed.

FIG. 5 illustrates a comparison of the common counterweight system 32 and the counterweight system 132. As illustrated in FIG. 5, the doors 122A-122G of the counterweight system 132 eliminate the counterweight casting slabs 124 found in the common counterweight system 32. This lowers the cost of the improved counterweight system 132. The thickness of the doors 122A-122G can be increased or decreased in order to adjust the weight of the counterweight box 97.

Additionally, by eliminating the counterweight casting slabs 124, the length of the counterweight box 97 is increased as compared to the common counterweight system 32. In particular, the illustrated counterweight system 132 has the following dimensions: approximately 180 inches long (as measured along a distance from the front end 114 toward the back end 116), approximately 528 inches wide (as measured along a distance between the first side wall 104 and second side wall 106), and approximately 59 inches high (as measured along a distance between the top wall 100 and bottom wall 102). Other dimensions are also possible. As a comparison, the corresponding dimensions of the common counterweight system 32 are approximately 156 inches long, approximately 418 inches wide, and approximately 59 inches high, respectively. Therefore, the length of the improved counterweight system 132 is increased by approximately 24 inches and the width is increased by approximately 109 inches. Increasing the size of the counterweight system 132 allows more counterweight material to be used in the counterweight system 132 as needed to increase the counterweight of the shovel 10. In particular, because of the increase in dimensions, the overall weight capacity of the counterweight units in the counterweight system 132 is approximately 20,000 pounds more than in the common counterweight system 32, and the counterweight box 97 is approximately 100,000 pounds more than in the common counterweight system 32.

Figure 6:
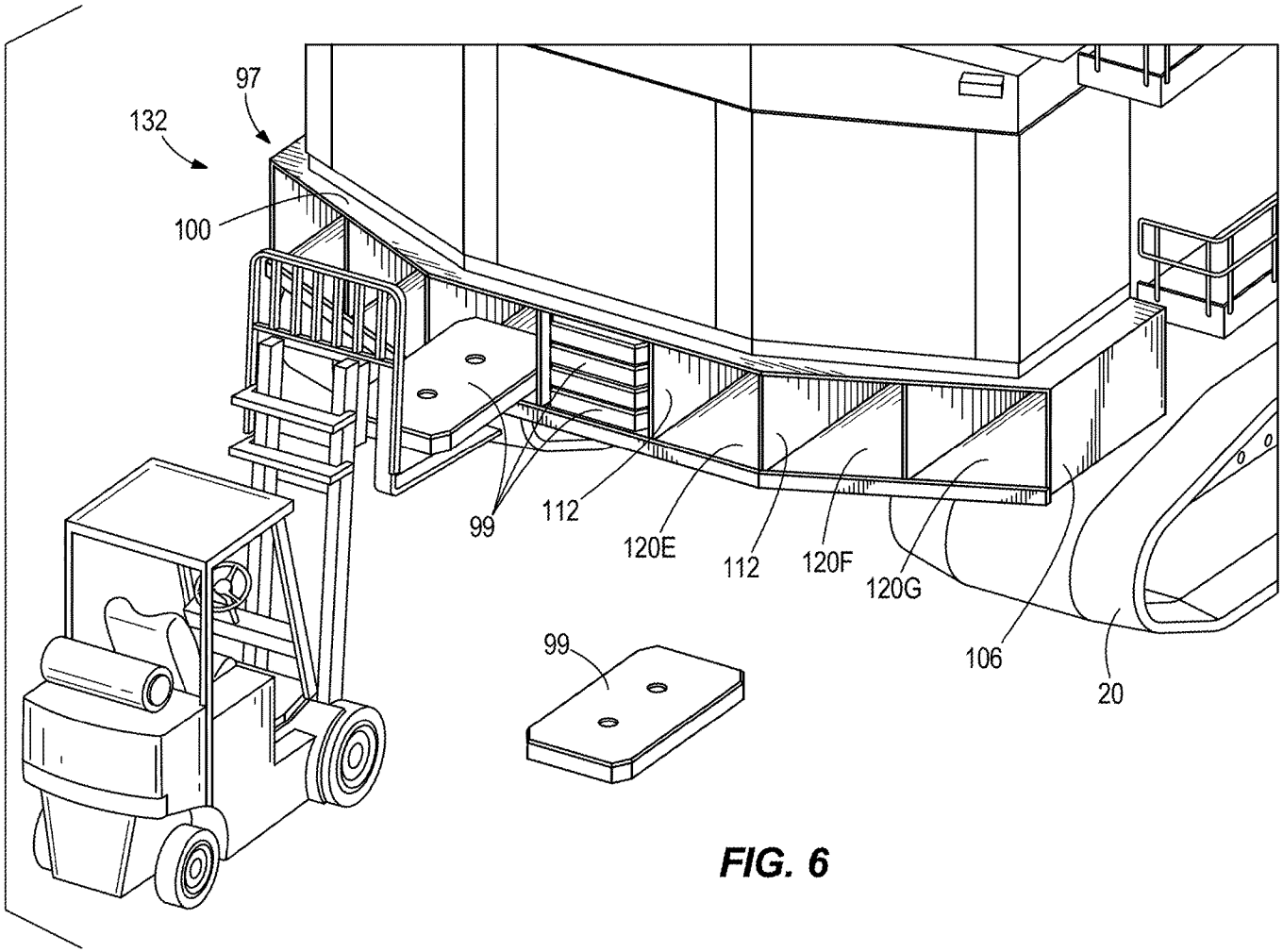
FIG. 6 illustrates a front side perspective view of the counterweight system of FIG. 2, along with a process of loading modular counterweight units into the counterweight system.

With reference to FIG. 6, the counterweight box 97 is adapted to receive modular counterweight units 99 (slabs in the illustrated construction). With the doors 122A-G removed, an operator inserts the counterweight units 99 into the apertures 120A-G at the back end 116. The operator uses a forklift to insert or remove the counterweight units 99. In other constructions, other lifting mechanisms are used to insert/remove the counterweight units 99. Each counterweight unit 99 is shaped to generally fit the contours of apertures 120A-G. Several columns of counterweight units 99 are placed in each aperture 120A-G. In other constructions, the counterweight units 99 have a different size and shape than that shown in FIG. 6. The counterweight units 99 are constructed from steel, although other material is also possible. In some constructions, if the shovel 10 is a relatively large shovel, modular units 99 with heavier weight or density, or more units, are used. If the shovel 10 is a relatively small shovel, modular units 99 with lighter weight or density, or fewer units, are used. Different shapes of units 99 are also used, depending on the available space and geometry available in the apertures 120A-G.

Figure 6A:
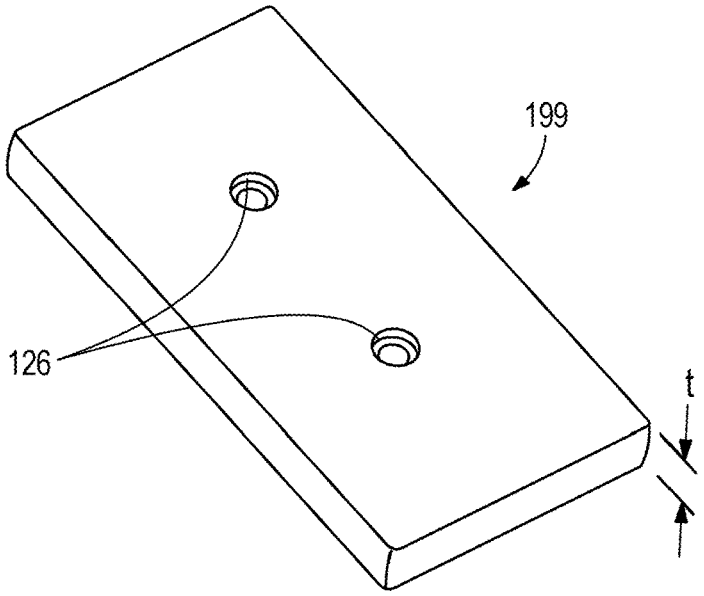
FIG. 6A is a perspective view of a modular counterweight unit according to one construction of the invention.

With reference to FIG. 6A, one particular construction of a modular counterweight unit 199 is illustrated. The counterweight unit 199 is made entirely from cast steel. The counterweight unit 199 has a generally rectangular configuration, with a thickness "t" of approximately 7 inches. The counterweight unit 199 includes lift points 126 for lifting the counterweight unit 199 for placement in the body 97. In the illustrated construction, the lift points 126 are apertures configured to receive lifting/picking hooks or eyes. The counterweight unit 199 is engageable and movable with the lifting hooks using a forklift or with other machinery.

Figure 6B:
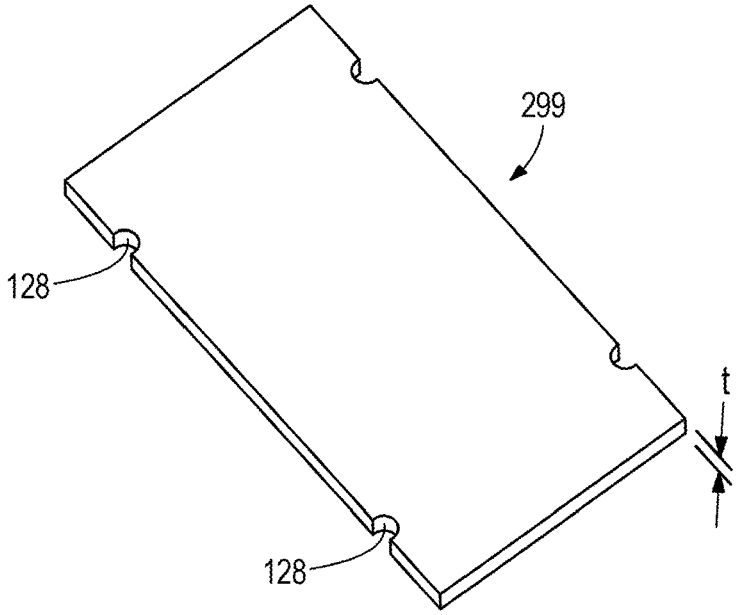
FIG. 6B is a perspective view of a modular counterweight unit according to another construction of the invention.
Figure 7:
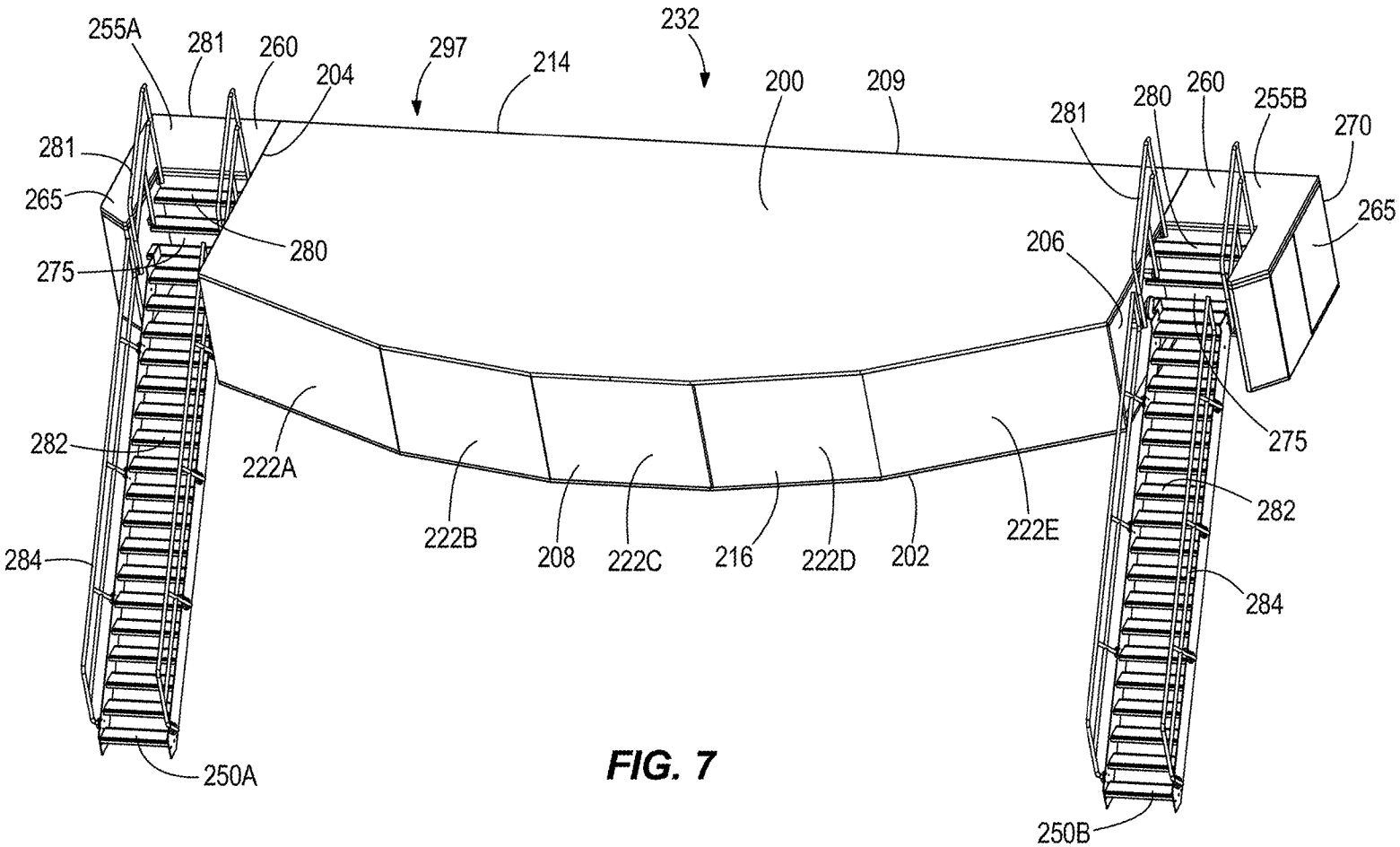
FIG. 7 is a front side perspective view of an improved counterweight system according to another construction of the invention, the counterweight system including access staircases.
Figure 8:
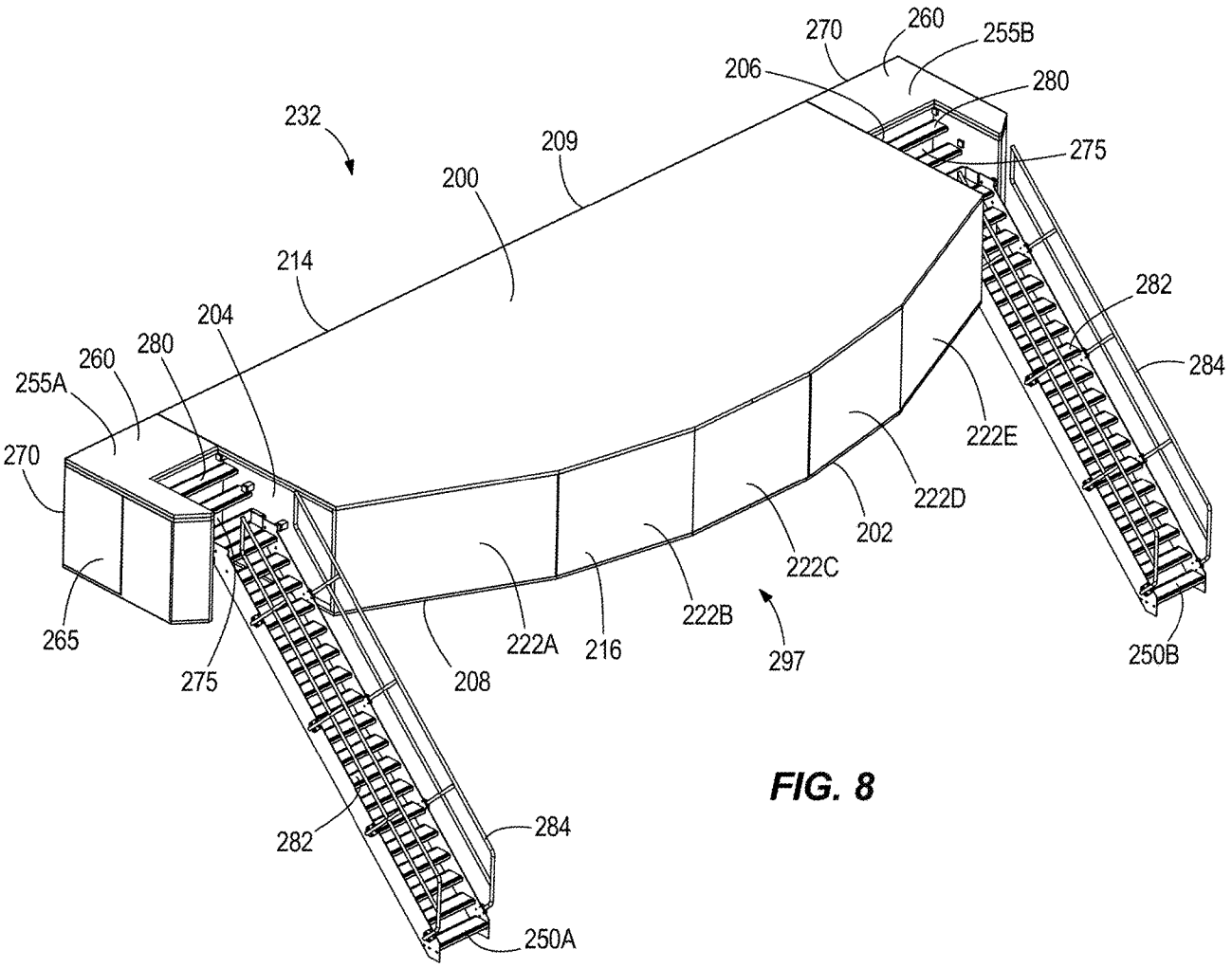
FIG. 8 is a front side perspective view of the counterweight system of FIG. 7, wherein the staircases are in extracted position.
Figure 9:
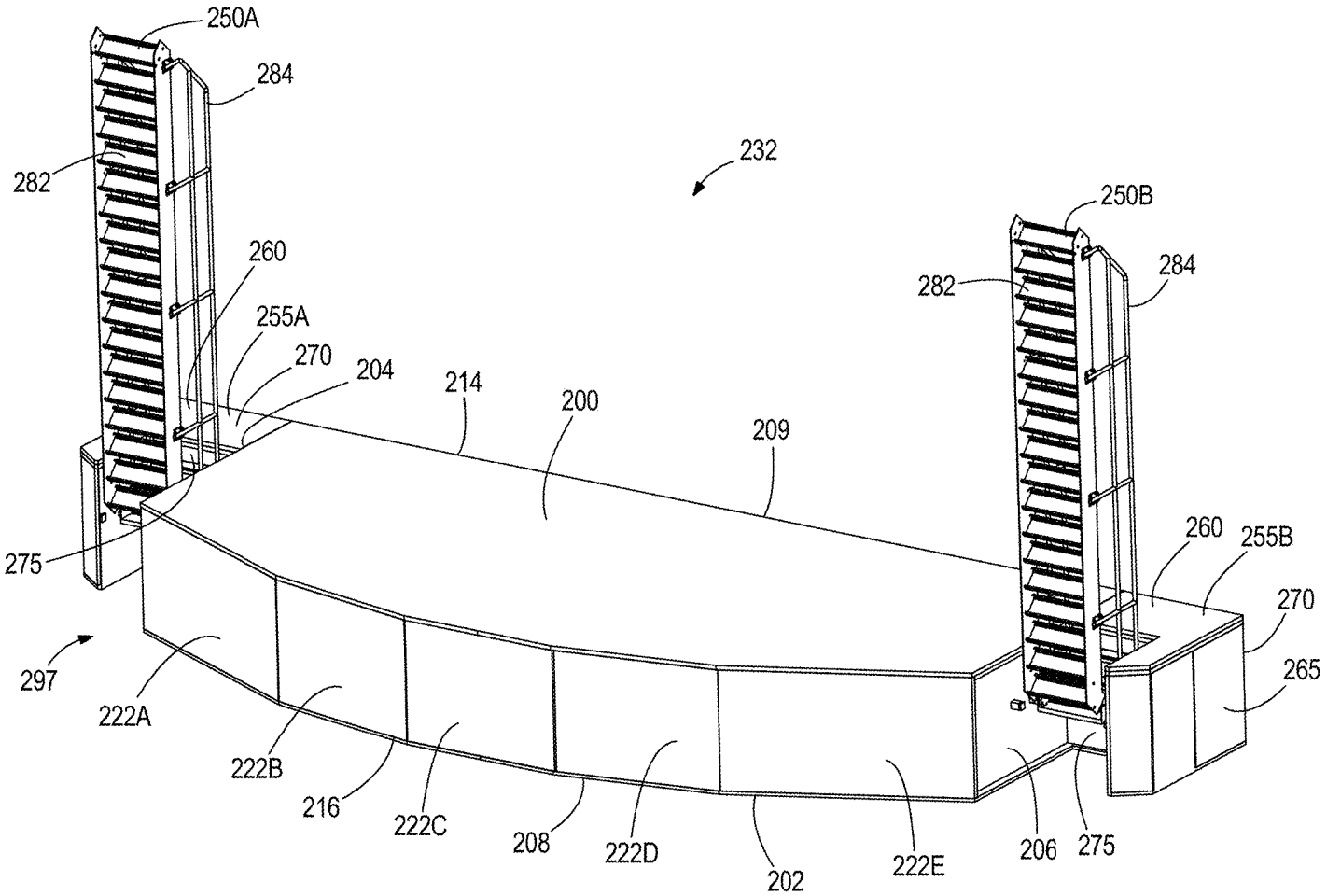
FIG. 9 is a front side perspective view of the counterweight system of FIG. 7, wherein the staircases are in retracted position.

With reference to FIG. 6B, another construction of a modular counterweight unit 299 is illustrated. The counterweight unit 299 is made of steel. The counterweight unit 299 has a generally rectangular configuration, with a thickness "t" of approximately 7 inches. The counterweight unit 299 includes lift points 128 for lifting the counterweight unit 299 for placement in the body 97. In the illustrated construction, the lift points 128 are cutouts that permit the unit 299 to be crane lifted. Slings, fork lifts, and other structures are also able to move the unit 299.

FIGS. 7-10 illustrate another construction of an improved counterweight system 232. The construction of the counterweight system 232 employs much of the same structure and has many of the same properties as the previously-described counterweight system 132 shown in FIGS. 2-6.

The counterweight system 232 addresses concerns regarding staircases in current machinery. For example, large mining or construction machines and other types of draglines, tractors, off-road haul vehicles, etc. are often operated by operators that are positioned significantly above the ground level. As illustrated in FIG. 1, the operator's cab 44 is located on top of the operator's frame 30 on shovel 10. The location of the operator's cab 44 can be fifteen feet or greater above ground level. The operator's cab 44 is accessible via a staircase 130. The operator uses the staircase 130 to climb to the operator's cab 44 using his or hers hands and feet. The staircase 130 is tucked away on the side of the frame 30.

When an operator needs to step down from the operator's cab 44, the shovel 10 must be positioned in a specific direction in order for the staircase 130 to open properly and to provide access to the ground. If the frame 30 of the shovel 10 is not positioned in parallel with the drive tracks 20 of the shovel, the staircase 130 cannot properly open because it will be blocked by the drive tracks 20 of the shovel. Therefore, when an operator needs to use the staircase 130, the operation of the shovel 10 must be interrupted and the shovel 10 must be positioned accordingly so the staircase 130 can reach the ground without contacting other elements of the shovel 10. For that reason, the existing safety code requires that the end of the staircase 130 extend beyond a tail wing radius of the shovel 10. Still, in some situations, the existing staircase 130 comes into contact and is stricken by the tracks 20 of the shovel 10, which results in a damage of the staircase 130, the frame 30, and/or the tracks 20.

Figure 10:
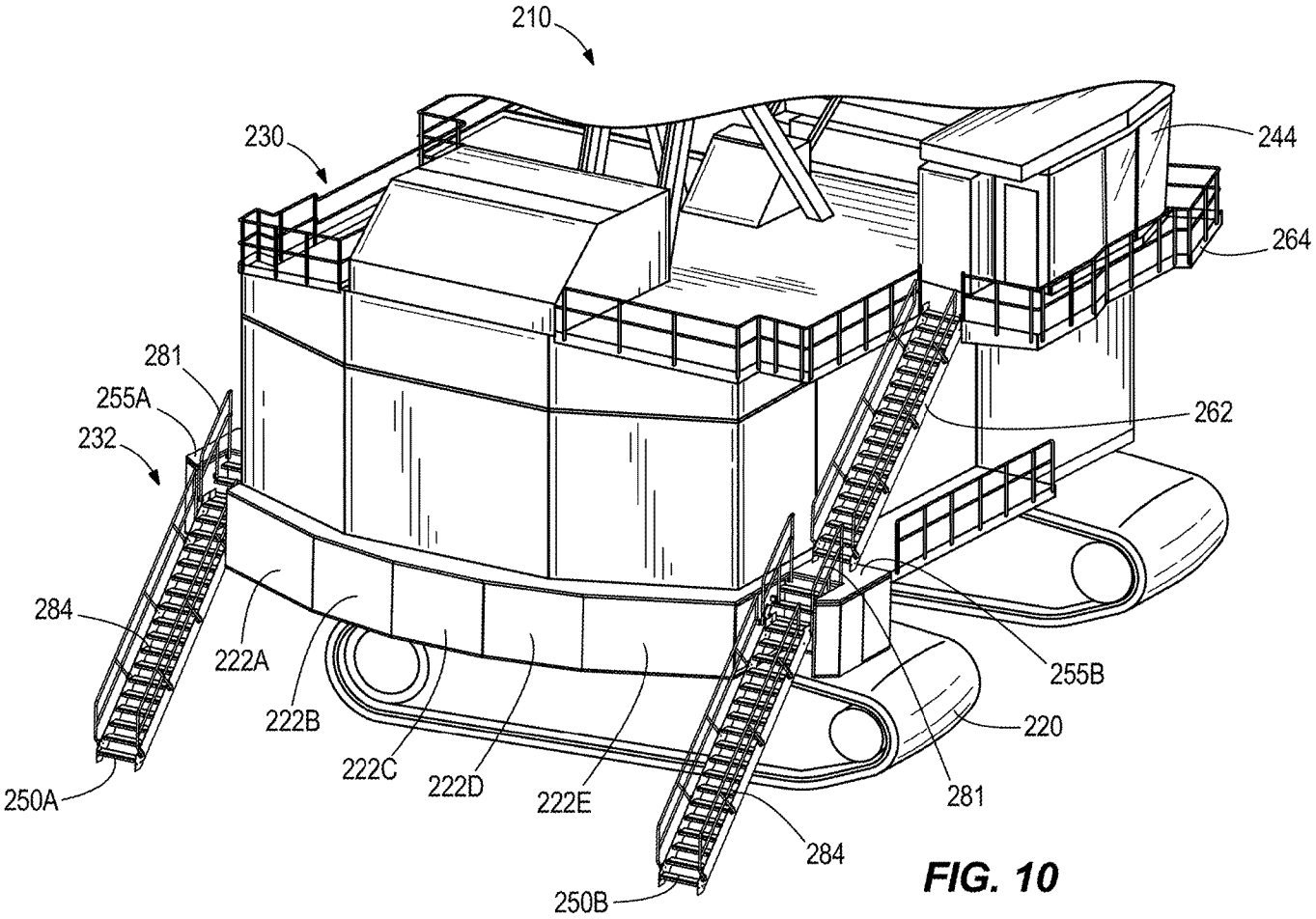
FIG. 10 is a front side perspective view of the counterweight system of FIG. 7, attached to an industrial machine.

With reference to FIGS. 7-10, the counterweight system 232 addresses the concerns regarding staircases by providing a counterweight box 297 defining a cavity and two staircases 250A and 250B for use on a shovel 210 (FIG. 10). The counterweight box 297 includes a top wall 200, a bottom wall 202, a first side wall 204, a second side wall 206, a back wall 208, a front wall 209, and internal walls (not shown). The counterweight box 297 further includes two supporting elements 255A and 255B coupled to the first and the second side walls 204 and 206, respectively. The supporting elements 255A and 255B are configured to engage and support the staircases 250A and 250B during operation of the shovel 210. In the illustrated construction, the top wall 200 and the bottom wall 202 are coupled (e.g. welded and/or bolted) to the side walls 204 and 206, the back wall 208, and the front wall 209. Further, the supporting elements 255A and 255B are coupled (e.g. welded and/or bolted) to the respective side wall 204, 206. The counterweight box 297 and the supporting elements 255A and 255B define a first, front end 214 and a second, back end 216, the front end 214 positioned closer to a rotational axis of the shovel 210 (similar to axis 27 in FIG. 1) than the second end 216. The first end 214 is a closed end, and the second end 216 (without doors) is an open end.

The counterweight box 297 includes five apertures (not shown) covered by a plurality of doors 222A-E. In other constructions, other numbers of apertures and doors are used. The counterweight box 297 is adapted to receive modular counterweight units (e.g. units 99, 199, 299).

Each of the supporting elements 255A, 255B includes a top platform 260, a side portion 265, a front portion 270, and an inner, rear portion 275. With reference to FIG. 10, the top platforms 260 are coupled to and support at least one additional staircase 262. The additional staircases 262 couple the top platforms 260 to additional platforms 264 that are positioned on the top of the frame 230 and that provide a direct access to the operator's cab 244.

The inner portions 275 of the supporting elements 255A and 255B are positioned between the side portions 265 of the supporting elements and the respective side wall 204, 206 of the counterweight box 297. The inner portions 275 are configured to accept and support the staircases 250A and 250B. The staircases 250A and 250B are moveably coupled to each inner portion 275 (e.g. by welding, bolting, or other suitable mechanical connections). The inner portions 275 of the supporting elements 255A and 255B further include steps 280, and one or more handrails 281 (shown in FIG. 7). One side of the steps 280 is coupled to the side portions 265 of the supporting elements 255A and 255B. The other side of the steps 280 is coupled to the side walls 204 and 206 of the counterweight box 297. The lowest of the steps 280 immediately precedes and is connected to the staircases 250A and 250B.

The staircases 250A and 250B are coupled to and extend from the supporting elements 255A and 255B. The staircases 250A and 250B include steps 282 and one or more handrails 284. In other constructions, the staircases 250A and 250B have different form and/or structure. When the shovel 210 is operating, the staircases 250A and 250B are retracted in an upright position (FIG. 9) where the staircases 250A and 250B are generally perpendicular to the surface of the top wall 200 of the counterweight box 297. In that position, the shovel 210 can freely rotate and operate to extract material from the ground. When the operator needs to reach the ground, the staircases 250A and 250B are lowered until one end of the staircases reaches the ground. Because the staircases 250A and 250B are connected to the counterweight system 232 and positioned at a rear side of the shovel 210, the staircases 250A and 250B do not have any contact with the drive tracks 220. Therefore, the staircases 250A and 250B do not interrupt operation of the shovel 210. Additionally, because of the wider counterweight box 297, as compared with conventional boxes 132, the staircases 250A and 250B are placed far enough away to not interfere with the drive tracks 220.

The staircases 250A and 250B are raised and lowered manually, using a supporting chain (not shown). In other constructions, the staircases 250A and 250B are raised and lowered automatically. For example, the staircases 250A and 250B are connected to a mechanical device driven by an electrical motor that is operable to lower and raise the staircases 250A and 250B. In some constructions, the mechanical device moving the staircases 250A and 250B is connected to a main controller of the shovel 210. Therefore, the operator can raise and/or lower the staircases 250A and 250B by operating switches on a control board in the operator's cab 244. In another construction, the mechanical device moving the staircases 250A and 250B is connected to a main control center and is operated remotely from the shovel 210.

The staircases 250A, 250B are integrated in the system 232 such that they are positioned away from a high bank for accessing or departing the machine. The staircases 250A, 250B are protected from damage when the shovel 210 is swinging during operation. The staircases 250A and 250B do not interfere with the operation of the shovel 210 and are lowered and/or raised at any point or any position of the operation of the shovel 210. Therefore, the shovel 210 does not need to be specifically positioned in order for the operator to use the staircases 250A and 250B. The staircases 250A and 250B further provide added counterweight for the shovel 210. In addition, positioning the staircases 250A, 250B at the rear of the shovel 210 allows integrating wider staircases 250A and 250B that provide easier access to the shovel 210 and allow carrying larger equipment onboard the shovel 210. Because of the configuration and position of the staircases 250A and 250B, the staircases 250A and 250B include fewer steps than may otherwise be necessary in other staircases (e.g. staircase 130).

Figure 11:
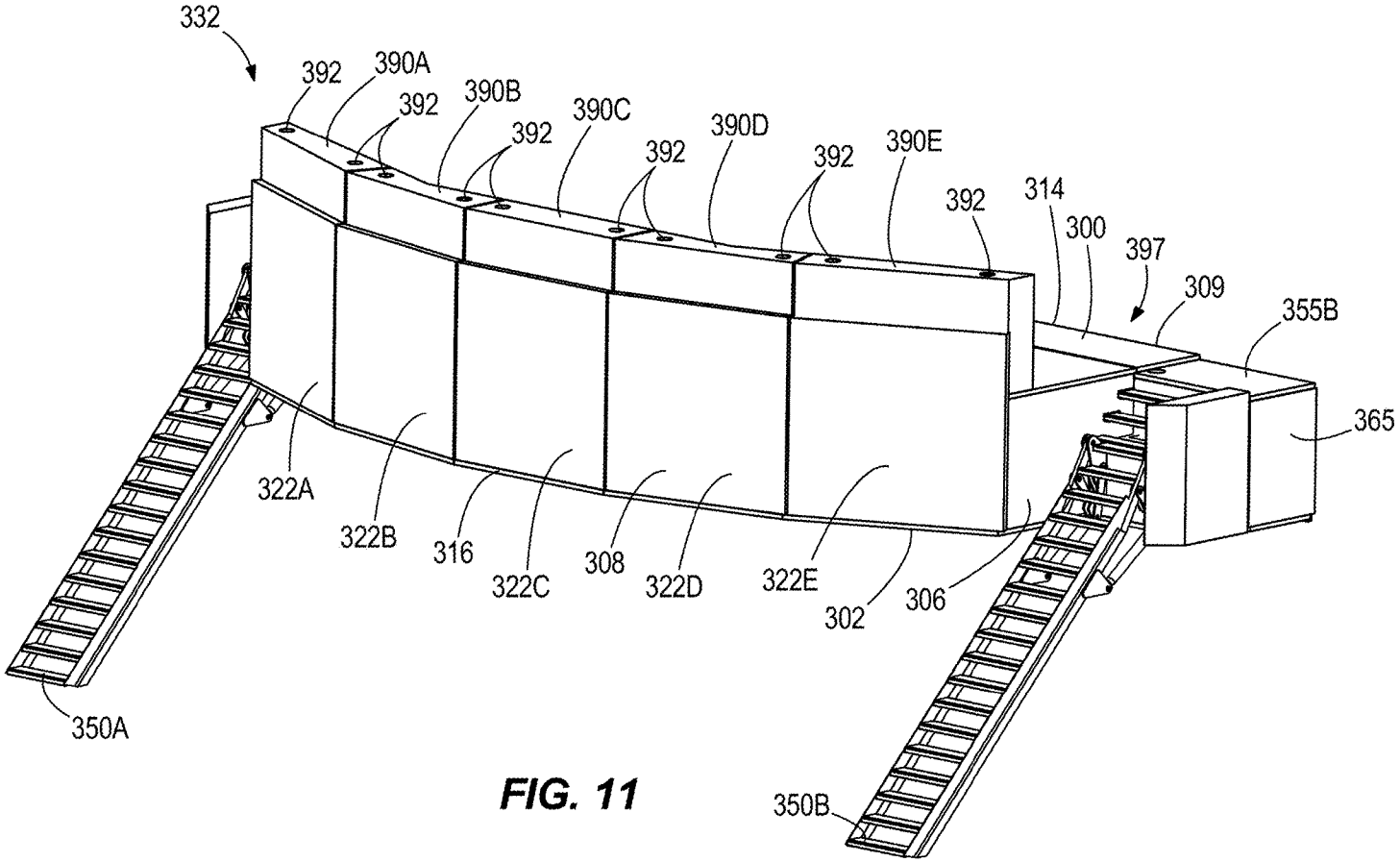
FIG. 11 is a front side perspective view an improved counterweight system according to another construction of the invention, the counterweight system including a plurality of external plates.
Figure 12:
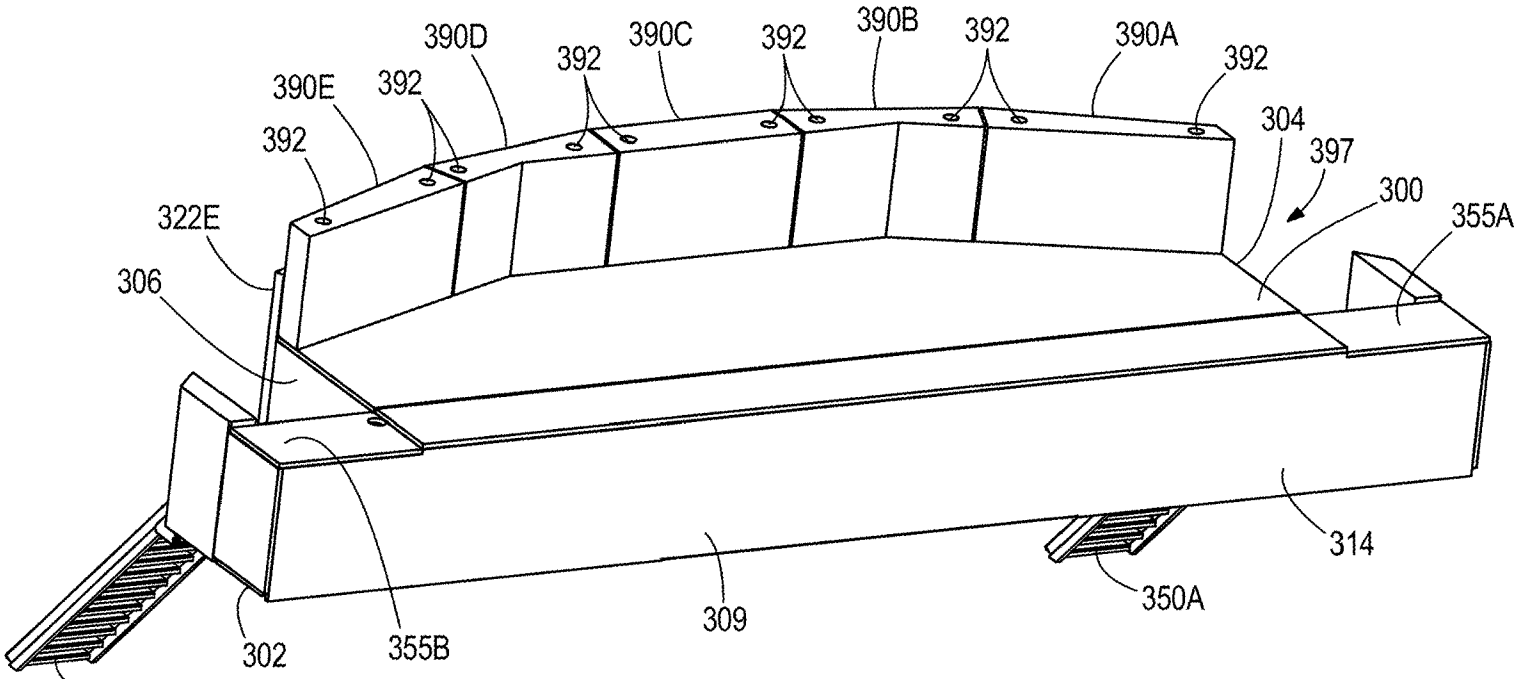
FIG. 12 is a back side perspective view of the counterweight system of FIG. 11.
Figure 13:
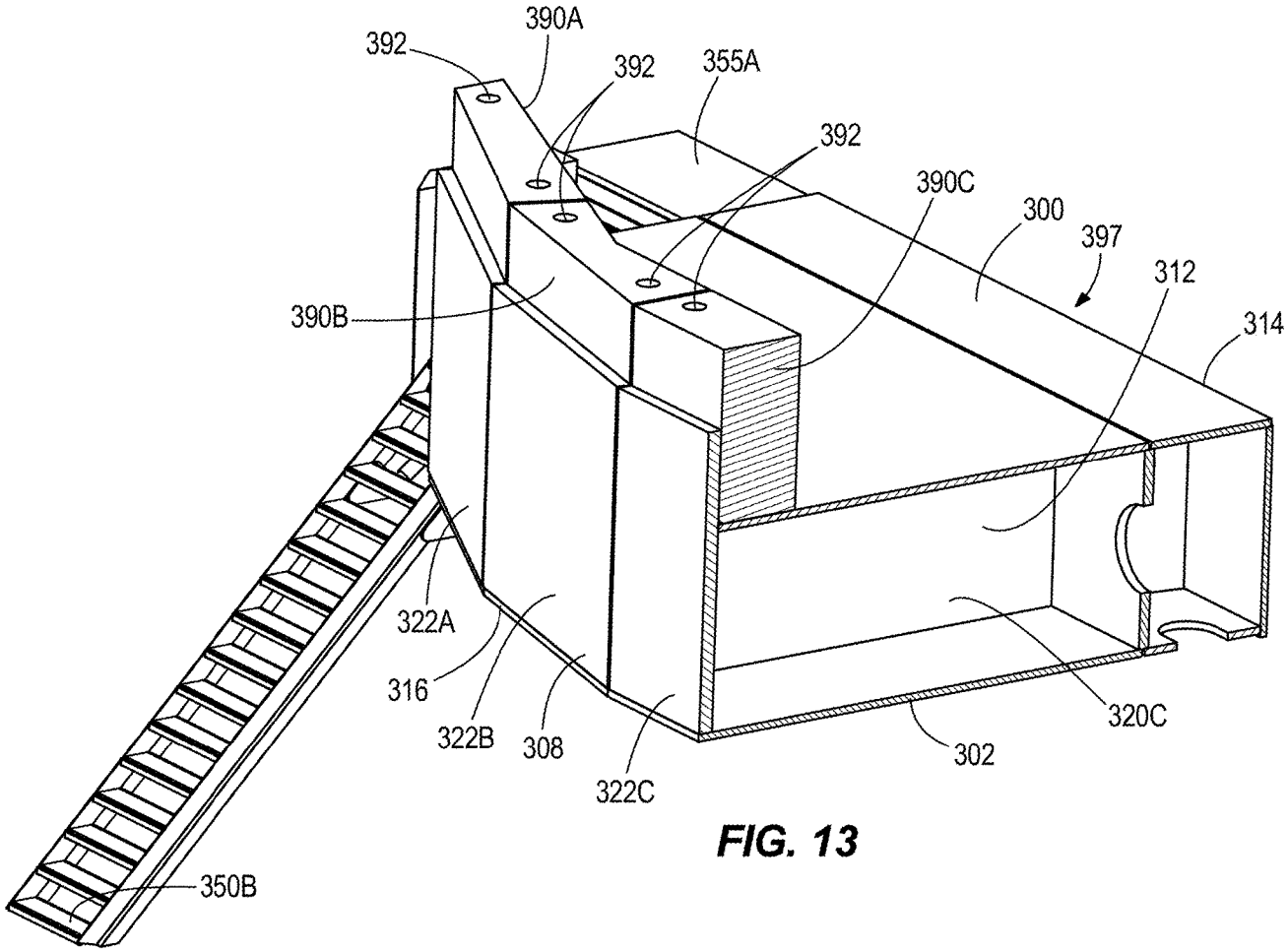
FIG. 13 is a front side perspective, cross-sectional view of the counterweight system of FIG. 11.

FIGS. 11-13 illustrate another construction of an improved counterweight system 332. The construction of the counterweight system 332 employs much of the same structure and has many of the same properties as the previously-described counterweight systems 132, 232 shown in FIGS. 2-10.

Similar to the counterweight system 232, the counterweight system 332 is used on shovel 210, and includes a counterweight box 397 defining a cavity with a top wall 300, a bottom wall 302, a first side wall 304, a second side wall 306, a back wall 308, a front wall 309, and internal walls 312. The counterweight box 397 further includes two supporting elements 355A and 355B coupled to the first and the second side walls 304 and 306, respectively. The supporting elements 355A and 355B are configured to engage and support staircases 350A and 350B during the operation of the shovel 210. The top wall 300 and the bottom wall 302 are welded and/or bolted to the side walls 304 and 306, the back wall 308, and the front wall 309. Further, the supporting elements 355A and 355B are welded and/or bolted to the respective side walls 304, 306. The counterweight box 397 and the supporting elements 355A and 355B define a first, front end 314 and a second, back end 316, the front end 314 positioned closer to a rotational axis of the shovel 310 (similar to axis 27 in FIG. 1) than the second end 316. The first end 314 is a closed end, and the second end 316 (without doors) is an open end.

The counterweight box 397 further includes five doors 322A-E that in the illustrated construction are welded in place on the counterweight box 397 and cover apertures (e.g. aperture 320C illustrated in FIG. 13) in the counterweight box 397. In other constructions other numbers of doors are used. The counterweight box 397 is adapted to receive modular counterweight units (e.g. units 99, 199, 299) when the doors 322A-E are removed. As illustrated in FIGS. 11-13, portions of the doors 322A-E extend above the top wall 300.

The counterweight system 332 further includes five external plates 390A-E. The external plates 390A-E are located adjacent the portions of the doors 322A-E that extend above the top wall 300. The external plates 390A-E are coupled to the top wall 300, although in some constructions the external plates 390A-E are coupled to the doors 322A-E or to both the doors 322A-E and the top wall 300. The external plates 390A-E include apertures 392 that extend through the external plates 390A-E, and are used to couple the external plates 390A-E to the top wall 300. Specifically, the external plates 390A-E are placed over standoffs (not shown) on top of the counterweight box, and are then welded into place on the top wall 300. The external plates 390A-E are formed of material similar to or identical to the doors 322A-E, although other materials are also possible. The external plates 390A-E are optionally used to adjust the weight of the counterweight system 332 if a heavier dipper 70 is used, or if the payload of the shovel 210 is increased after the shovel 210 is running. For example, if a heavier dipper 70 is used, one or more external plates 390A-E are coupled to the counterweight box 397 to provide additional counterweight.

While the external plates 390A-E are illustrated on a counterweight system 332 that includes staircases 350A, 350B, in other constructions the external plates 390A-E are used on constructions of a counterweight system that does not include staircases 350, 350B, such as counterweight system 332 described above.

Overall, the improved counterweight systems 132, 232, 332 facilitate quick and easy installation and/or removal of counterweight material (e.g., counterweight units) through, a rear, back end 116, 216, 316 of the counterweight box 97, 297, 397 rather than through openings on the top of the counterweight box as found in current designs. Installing and/or removing counterweight units through the back end allows forklifts or other machinery to easily reach the apertures along the back of the counterweight boxes. The counterweight systems 132, 232, 332 allow a rear room (e.g. room 31) of a shovel to be installed immediately after installation of the counterweight box, rather than having to wait until the counterweight box is filled. The counterweight systems 132, 232, 332 eliminate the need for outer counterweight casting slabs 124 found in current counterweight systems that tend to break and fall off during the operation of the machine, while still allowing addition of one or more external plates 390 if desired to increase the overall counterweight. The counterweight systems 132, 232, 332 additionally decrease the man hours and build time for assembling the shovel 10, 210 and allow for quick and easy addition/removal of counterweight if the shovel 10, 210 needs to travel a long distance, or if the shovel 10, 210 is disassembled and moved to a different location. Also, and as described above, some of the counterweight systems 132, 232, 332 also provide movable stairwells 250A, 250B, 350A, 350B that generate better access to the operator cabs than current designs, and advantageously utilize the stairwells as added counterweight.

Although the invention has been described in detail with reference to certain preferred embodiments, variations and modifications exist within the scope and spirit of one or more independent aspects of the invention as described.

The invention claimed is:

1. A mining machine comprising:
a base having a first end and a second, opposite end;
drive tracks coupled to the base;
a boom coupled to the base and extending from the first end of the base;
a handle coupled to the boom;
a dipper coupled to the handle; and
a counterweight system coupled to the second end of the base, the counterweight system having:
a body having a top wall, a bottom wall, a first side wall, a second side wall, and a plurality of internal walls disposed between the first side wall and the second side wall, each internal wall extending in a direction from the top wall to the bottom wall, wherein the internal walls and the first and second side walls define a plurality of internal sections; and
a plurality of counterweight slabs, each counterweight slab sized to fit entirely within one of the internal sections by inserting the counterweight slab laterally along a direction toward the first end of the base;
wherein the body has a back wall that defines a first, closed end of the body, wherein the body includes a second, opposite open end for providing access to the internal sections, wherein each counterweight slab is sized to fit entirely within one of the internal sections by inserting the counterweight slab laterally into the second, open end and toward the first, closed end, wherein the body has a plurality of intermediate walls spaced from the back wall and disposed between the first, closed end and the second, opposite end, and wherein the intermediate walls define back ends of the internal sections.

2. The mining machine of claim 1, wherein each of the intermediate walls extends parallel to the back wall.

3. The mining machine of claim 1, wherein at least one of the intermediate walls includes a cut-out region.

4. The mining machine of claim 1, wherein each of the internal sections has an identical size.

5. The mining machine of claim 1, wherein one of the internal sections has a size that is different than another one of the internal sections.

6. The mining machine of claim 1, wherein each of the plurality of counterweight slabs is a steel slab.

7. The mining machine of claim 1, wherein each of the plurality of counterweights slabs is rectangular, and has a thickness of approximately 7 inches.

8. The mining machine of claim 1, wherein each of the counterweight slabs includes a lift point for lifting the counterweight slab and placing the counterweight slab into one of the internal sections.

9. The mining machine of claim 8, wherein the lift point includes an aperture configured to receive a lifting hook.

10. The mining machine of claim 1, wherein the counterweight system includes a first staircase coupled to the first side wall and a second staircase coupled to the second side wall.

11. The mining machine of claim 10, wherein each of the first and second staircases are retractable to an upright position.

12. A mining machine comprising:
a base having a first end and a second, opposite end;
drive tracks coupled to the base;
a boom coupled to the base and extending from the first end of the base;
a handle coupled to the boom;
a dipper coupled to the handle; and
a counterweight system coupled to the second end of the base, the counterweight system having:
a body having a top wall, a bottom wall, a first side wall, a second side wall, a back wall, and a plurality of internal walls disposed between the first side wall and the second side wall, each internal wall extending in a direction from the top wall to the bottom wall, wherein the internal walls and the first and second side walls define a plurality of internal sections, wherein the back wall defines a first, closed end of the body, wherein the body includes a second, opposite open end for providing access to the internal sections, wherein the body further includes a plurality of intermediate walls spaced from the back wall and disposed between the first, closed end and the second, opposite end, wherein the intermediate walls define back ends of the internal sections, and wherein at least one of the intermediate walls includes a cut-out section.

13. The mining machine of claim 12, wherein one of the internal sections has a size that is different than another one of the internal sections.

14. The mining machine of claim 12, wherein the counterweight system includes a first staircase coupled to the first side wall and a second staircase coupled to the second side wall, wherein each of the first and second staircases are retractable to an upright position.

15. A mining machine comprising:
a base having a first end and a second, opposite end;
drive tracks coupled to the base;

a boom coupled to the base and extending from the first end of the base;

a handle coupled to the boom;

a dipper coupled to the handle; and a counterweight system coupled to the second end of the base, the counterweight system having:

a body having a top wall, a bottom wall, a first side wall, a second side wall, and a plurality of internal walls disposed between the first side wall and the second side wall, each internal wall extending in a direction from the top wall to the bottom wall, wherein the internal walls and the first and second side walls define a plurality of internal sections; and a plurality of counterweight slabs, each counterweight slab sized to fit entirely within one of the internal sections by inserting the counterweight slab laterally along a direction toward the first end of the base;

wherein the counterweight slabs are disposed within the body, wherein the body includes a back wall defining a first, closed end, and a plurality of doors coupled to the top wall and the bottom wall that define a second, closed end, wherein the body has a plurality of intermediate walls spaced from the back wall and disposed between the first, closed end and the second, closed end, and wherein the intermediate walls define back ends of the internal sections.

16. The mining machine of claim 15, wherein each of the intermediate walls extends parallel to the back wall.

17. The mining machine of claim 15, wherein at least one of the intermediate walls includes a cut-out region.

* * * * *